US011566798B2

(12) United States Patent
Huang

(10) Patent No.: US 11,566,798 B2
(45) Date of Patent: Jan. 31, 2023

(54) ELECTRIC CONTROL BOX ASSEMBLY AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventor: Huoxu Huang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 435 days.

(21) Appl. No.: 16/803,575

(22) Filed: Feb. 27, 2020

(65) Prior Publication Data

US 2021/0164669 A1 Jun. 3, 2021

Related U.S. Application Data

(63) Continuation of application No. PCT/CN2019/124907, filed on Dec. 12, 2019.

(30) Foreign Application Priority Data

Nov. 29, 2019 (CN) ..... 201911207052.5
Nov. 29, 2019 (CN) ..... 201922131593.6

(51) Int. Cl.

| | |
|---|---|
| ***F24F 1/22*** | (2011.01) |
| ***F24F 11/88*** | (2018.01) |
| ***F24F 11/89*** | (2018.01) |
| ***F24F 1/0323*** | (2019.01) |
| *F24F 1/031* | (2019.01) |
| *F24F 1/0314* | (2019.01) |
| *F24F 13/20* | (2006.01) |
| *F24F 13/24* | (2006.01) |

(52) U.S. Cl.

CPC ..... *F24F 1/22* (2013.01); *F24F 1/0323* (2019.02); *F24F 11/88* (2018.01); *F24F 11/89* (2018.01); *F24F 1/031* (2019.02); *F24F 1/0314* (2019.02); *F24F 13/20* (2013.01); *F24F 13/24* (2013.01); *F24F 2013/207* (2013.01)

(58) Field of Classification Search

CPC .... F24F 1/22; F24F 11/88; F24F 11/89; F24F 1/027

See application file for complete search history.

(56) References Cited

U.S. PATENT DOCUMENTS 5,253,485 A * 10/1993 Kennedy ..... F24F 1/027 62/262
5,467,610 A * 11/1995 Bolton ..... F24F 1/027 62/262
5,582,025 A * 12/1996 Dubin ..... F24F 13/32 62/262
D380,533 S * 7/1997 Molnar ..... D23/351
5,660,605 A * 8/1997 Chan ..... F24F 1/0071 96/26

(Continued)

*Primary Examiner* — Ramesh B Patel
(74) *Attorney, Agent, or Firm* — Anova Law Group PLLC

(57) ABSTRACT

An electric control box assembly includes an outer box body, an inner box body provided in the outer box body and including an insulating member, an electric control board provided in the inner box body, and a component provided in the outer box body and located outside the inner box body. The component is connected with the inner box body.

20 Claims, 7 Drawing Sheets

(56) References Cited

U.S. PATENT DOCUMENTS

| | | | | | |
|---|---|---|---|---|---|
| 6,023,937 | A * | 2/2000 | Rodrigues | F24F 13/20 | 62/295 |
| 6,155,065 | A * | 12/2000 | da Silva | F24F 1/022 | 62/262 |
| 6,189,328 | B1 * | 2/2001 | Mochizuki | F24F 1/0057 | 62/298 |
| 6,298,678 | B1 * | 10/2001 | Kim | F24F 1/027 | 62/262 |
| 6,330,807 | B1 * | 12/2001 | Correa | F24F 13/20 | 62/262 |
| 6,915,841 | B2 * | 7/2005 | Campbell | F24F 1/027 | 62/262 |
| 7,021,076 | B2 * | 4/2006 | Park | F24F 1/027 | 62/262 |
| 7,036,331 | B2 * | 5/2006 | Kim | F24F 13/20 | 62/262 |
| 7,082,780 | B2 * | 8/2006 | Stanko | F24F 1/027 | 62/262 |
| 7,121,105 | B1 * | 10/2006 | Rais | F24F 1/027 | 62/262 |
| 8,357,031 | B2 * | 1/2013 | Dinicolas | F24F 1/58 | 454/201 |
| 10,101,040 | B2 * | 10/2018 | Phillips | F24F 1/027 | |
| 2003/0110789 | A1 * | 6/2003 | Cur | F24F 1/027 | 62/262 |
| 2007/0137237 | A1 * | 6/2007 | Rais | F24F 1/027 | 62/262 |
| 2017/0191763 | A1 * | 7/2017 | Xu | F24F 1/027 | |
| 2021/0010691 | A1 * | 1/2021 | Luo | F24F 1/0314 | |

* cited by examiner

ELECTRIC CONTROL BOX ASSEMBLY AND AIR CONDITIONER

CROSS-REFERENCE TO RELATED APPLICATIONS

This application is a continuation of International Application No. PCT/CN2019/124907, filed on Dec. 12, 2019, which is based on and claims priority to Chinese Patent Application Nos. 201911207052.5 and No. 201922131593.6, both filed on Nov. 29, 2019, the entire contents of all of which are incorporated herein by reference.

FIELD

The present application relates to the field of electric equipment, and particularly to an electric control box assembly and an air conditioner.

BACKGROUND

In related art, an electric control box assembly of an electric appliance is configured to control an operation of the complete appliance. The electric control box assembly is assembled complicatedly, which is not conducive to modular assembly, resulting in a relatively low assembly efficiency thereof.

SUMMARY

The present application seeks to solve at least one of the problems existing in the related art to at least some extent. To this end, the present application provides an electric control box assembly which, by integrally connecting a component with an inner box body, facilitates the modular assembly of the electric control box assembly and improves the assembly efficiency of the electric control box assembly.

The present application also provides an air conditioner having the above-mentioned electric control box assembly.

An electric control box assembly according to an embodiment of a first aspect of the present application includes: an outer box body; an inner box body provided in the outer box body, the inner box body being an insulating member; an electric control board provided in the inner box body; a component provided in the outer box body and located outside the inner box body, the component being connected with the inner box body.

In the electric control box assembly according to the present application, by providing the component in the outer box body and outside the inner box body, connecting the component with the inner box body, and integrating the component and the inner box body, the modular assembly of the electric control box assembly is facilitated and the assembly efficiency of the electric control box assembly is improved.

According to some embodiments of the present application, a mounting bracket is provided at an outer side wall of the inner box body, and the component is connected to the mounting bracket.

Optionally, the mounting bracket is connected with the outer box body.

Further, the mounting bracket is connected with the outer box body by a first fastener, the inner box body is formed with a first positioning lug, and the outer box body is formed with a first pre-positioning hole fitted with the first positioning lug.

According to some optional embodiments of the present application, the inner box body is integrally formed with the mounting bracket.

According to some optional embodiments of the present application, the mounting bracket includes: two mounting sub-brackets disposed opposite to each other and spaced apart from each other, the component being accommodated in an accommodation space formed by the two mounting sub-brackets and the inner box body.

Further, the mounting sub-bracket has a mounting plate and a mounting column provided on the mounting plate, the component is provided with a connection lug, and a second fastener is configured to pass through the connection lug and the mounting column to connect the component to the mounting bracket.

Further, a fixation hole is formed in the electric control board, a fixation column is formed on the inner box body, a third fastener is configured to pass through the fixation hole and the fixation column to fix the electric control board in the inner box body, and a central axis of the third fastener is perpendicular to a central axis of the second fastener.

According to some embodiments of the present application, the electric control board is formed with a fixation hole and a plurality of positioning holes, the inner box body is formed with a fixation column and a plurality of positioning columns, a third fastener is configured to pass through the fixation hole and the fixation column to fix the electric control board in the inner box body, the number of positioning columns is the same as the number of positioning holes, and the positioning columns are in one-to-one-correspondence with the positioning holes.

Optionally, three positioning columns are provided and arranged in a triangle, and three positioning holes are provided and arranged in a triangle.

According to some embodiments of the present application, a portion of the outer box body accommodating the inner box body includes a first accommodation cavity, and a portion of the outer box body accommodating the component includes a second accommodation cavity. A cross sectional area of the second accommodation cavity is greater than a cross sectional area of the first accommodation cavity, and the cross sections are perpendicular to a direction along which the inner box body and the component are arranged.

Optionally, the outer box body has an open end, a portion of the outer box body opposite to the open end includes a back plate, and the back plate is stepped.

Further, a mounting bracket is provided at an outer side wall of the inner box body, the component is connected to the mounting bracket, and the inner box body and the mounting bracket form a stepped structure.

According to some embodiments of the present application, the outer box body is formed with a mounting lug configured to mount the outer box body to an appliance.

According to some embodiments of the present application, two spaced wiring holes are formed in the outer box body, one of the two wiring holes allows a high-voltage wire harness to pass through, and the other one of the two wiring holes allows a low-voltage wire harness to pass through.

According to some embodiments of the present application, the component is a transformer.

In an air conditioner according to an embodiment of a second aspect of the present application, an electric control system of the air conditioner includes: the electric control box assembly consistent with embodiments of the first aspect of the present application.

In the air conditioner according to the present application, by providing the above-mentioned electric control box assembly, the modularity of the electric control box assembly is relatively high, which makes the assembly efficiency of the electric control box assembly higher, and improves the assembly efficiency of the air conditioner.

According to some embodiments of the present application, the air conditioner is a window air conditioner.

According to some embodiments of the present application, the air conditioner includes: a chassis; and a fixation bracket provided on the chassis. The electric control box assembly is provided in the fixation bracket. The fixation bracket is provided with a baffle extending in a vertical direction, and the open end of the outer box body is opposite to and in contact with the baffle. A service opening is formed in a portion of the baffle opposite to the open end of the outer box body, and a cover configured to open and close the service opening is provided at the service opening.

According to some optional embodiments of the present application, a second positioning lug is formed at a lower end of the cover, the baffle is formed with a second pre-positioning hole fitted with the second positioning lug, and an upper end of the cover is connected with the baffle by a fourth fastener.

According to some optional embodiments of the present application, a wiring groove is formed in the baffle, and runs through an inner side wall of the service opening.

According to some optional embodiments of the present application, the fixation bracket includes a front enclosure plate and a front cover plate. The front cover plate covers a top of the front enclosure plate, an accommodation space is formed between the front cover plate and the front enclosure plate and accommodates an air duct member, an air duct is formed in the air duct member and communicated with an air inlet and an air outlet of the air conditioner, and a part of a side wall of the front cover plate is formed as the baffle.

According to some embodiments of the present application, the electric control system includes: a first electric control device provided at a side of an air duct member of the air conditioner in a horizontal direction, an air duct being formed in the air duct member and communicated with an air inlet and an air outlet of the air conditioner; a second electric control device configured as the electric control box assembly, and provided below the air duct member.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

The above-mentioned and/or additional aspects and advantages of the present application will become apparent and more readily appreciated from the following descriptions made with reference to the drawings, in which.

Figure 1:
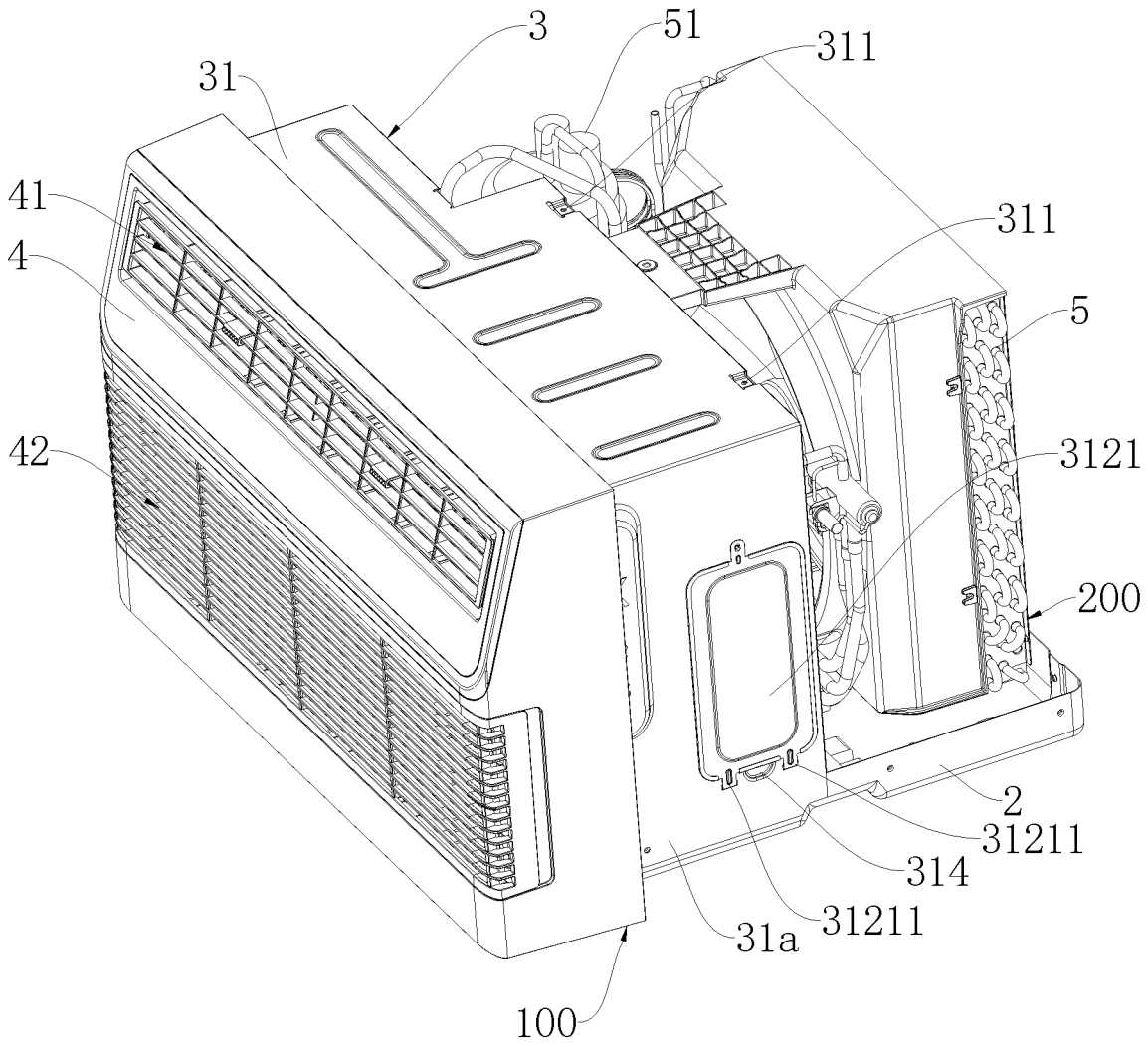
FIG. 1 is a schematic diagram of a partial structure of an air conditioner according to some embodiments of the present application.

REFERENCE NUMERALS electric control box assembly 1;

outer box body 11; first pre-positioning hole 111; first accommodation cavity 112; second accommodation cavity 113; open end 114; back plate 115; mounting lug 116; wiring hole 117;

inner box body 12; mounting bracket 121; mounting sub-bracket 121*a*; first positioning lug 1211; first fastener 12111; mounting plate 1212; mounting column 12121; second fastener 121211; fixation column 1213; third fastener 12131; positioning column 1214;

electric control board 13; fixation hole 131; positioning hole 132;

component 14; connection lug 141;

chassis 2;

fixation bracket 3; front cover plate 31; baffle 31*a*; cover plate screw hole 311; service opening 312; cover 3121; second positioning lug 31211; second pre-positioning hole 313; fourth fastener 3131; wiring groove 314; front enclosure plate 32; enclosure plate screw hole 321;

face frame assembly 4; air outlet 41; air inlet 42; air duct member 43;

outdoor heat exchanger assembly 5; compressor assembly 51;

indoor heat exchanger assembly 6;

first electric control device 7;

indoor unit 100; outdoor unit 200.

DETAILED DESCRIPTION

Reference will be made in detail to embodiments of the present application, and the examples of the embodiments are illustrated in the drawings, wherein the same or similar elements and the elements having same or similar functions are denoted by like reference numerals throughout the descriptions. The embodiments described herein with reference to drawings are illustrative, and merely used to explain the present application. The embodiments shall not be construed to limit the present application.

An electric control box assembly 1 according to an embodiment of the present application will be described below with reference to the drawings.

Figure 5:
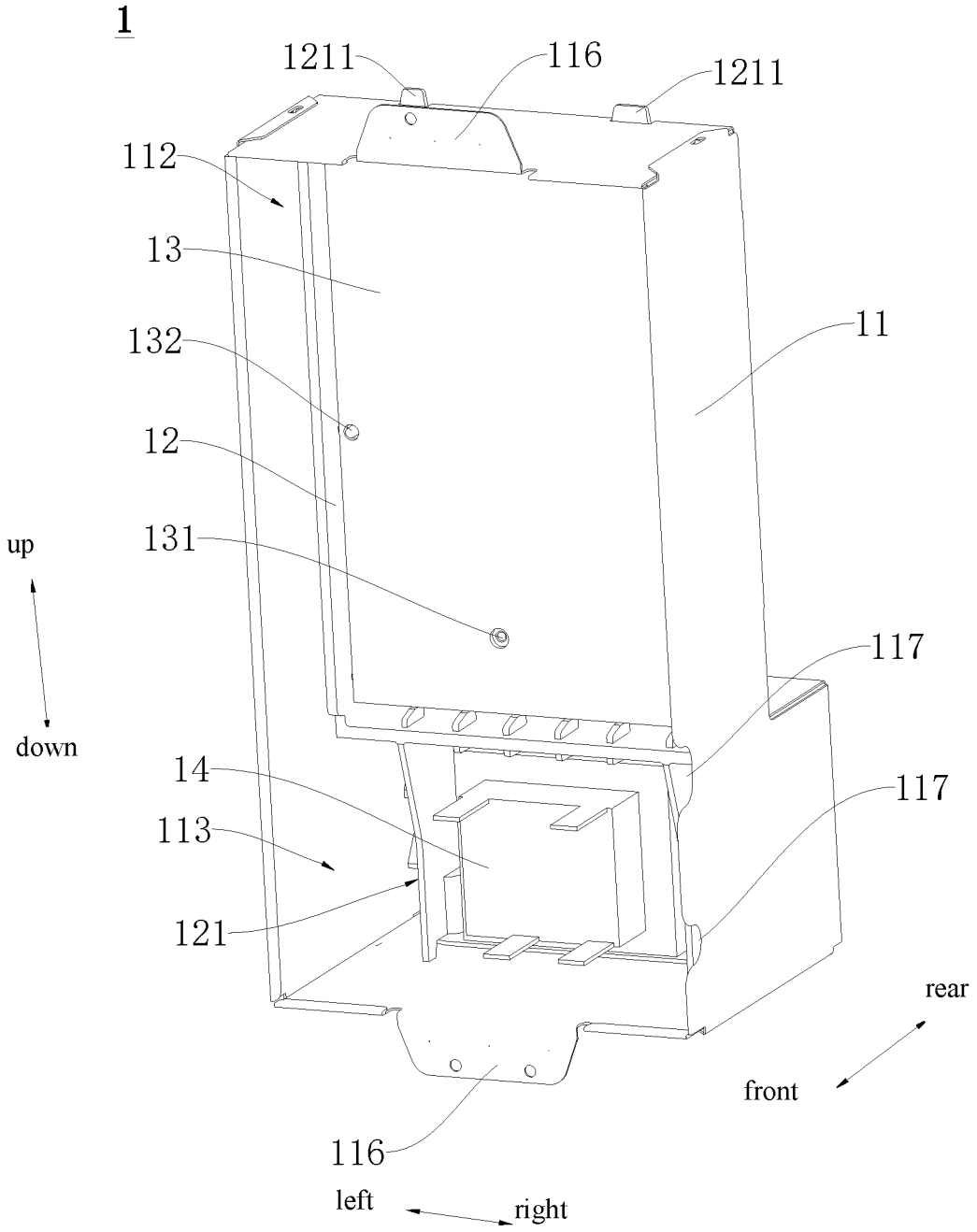
FIG. 5 is a structural diagram of an electric control box assembly according to some embodiments of the present application.
Figure 6:
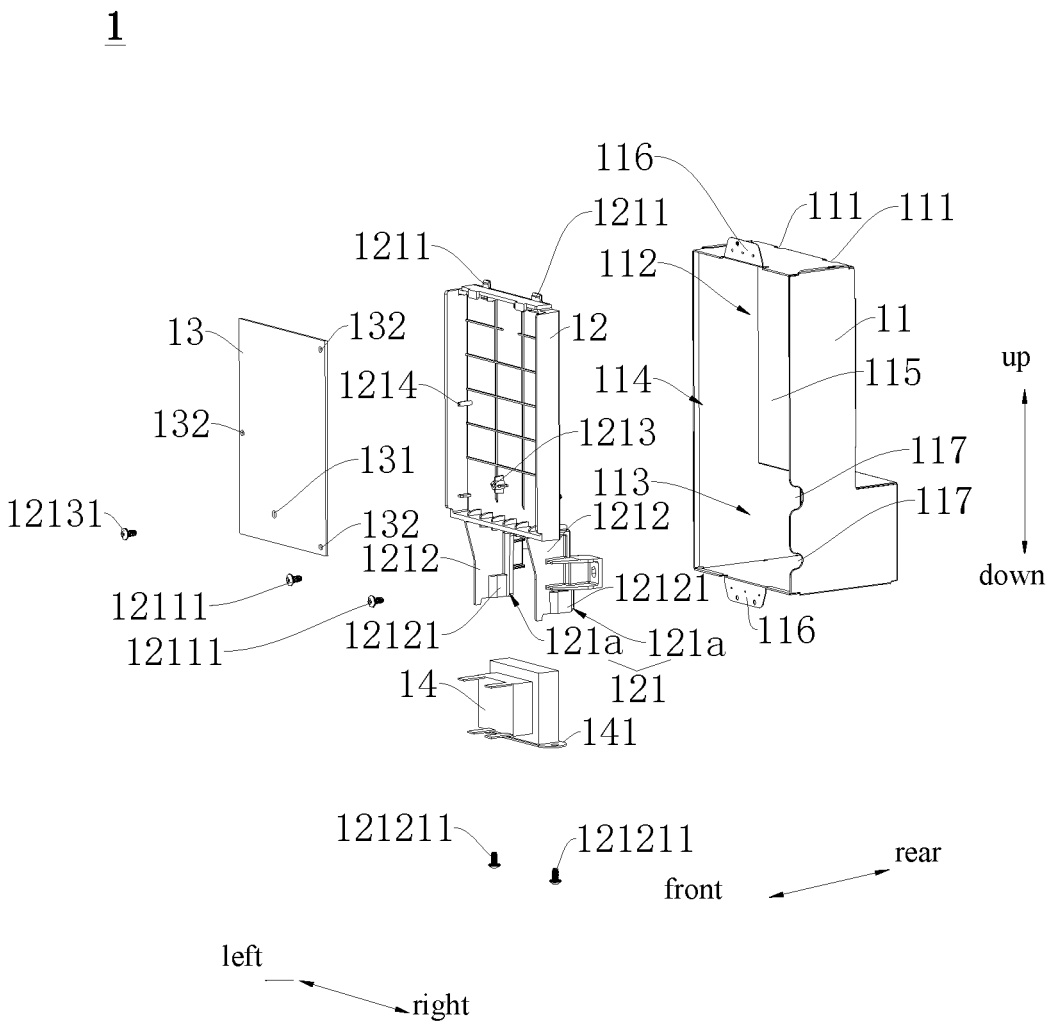
FIG. 6 is an exploded view of the electric control box assembly according to some embodiments of the present application.
Figure 7:
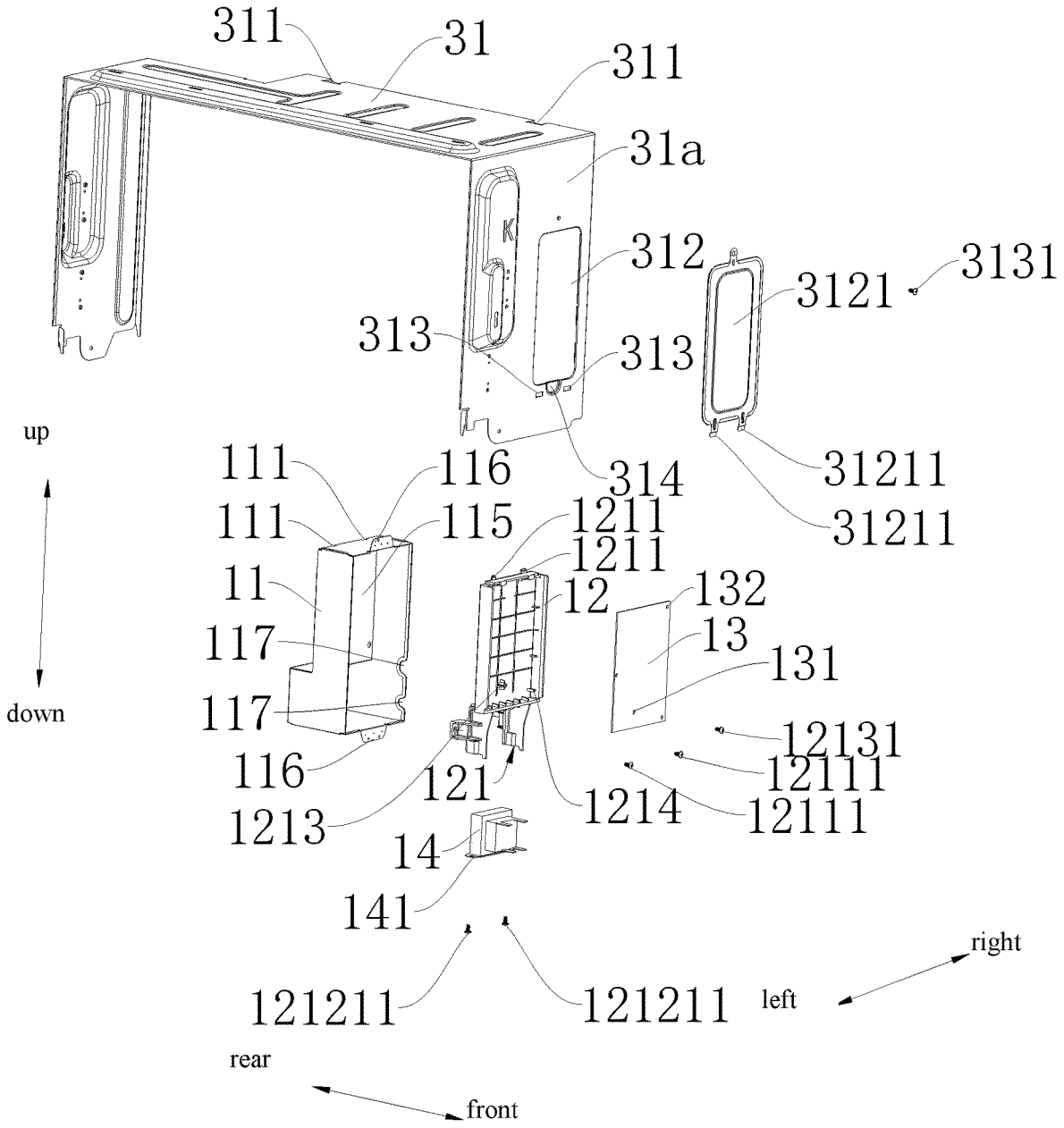
FIG. 7 is an exploded view of the electric control box assembly and a front cover plate according to some embodiments of the present application.

Referring to FIGS. 5 to 7, an electric control box assembly 1 consistent with embodiments of the present application includes an outer box body 11, an inner box body 12, an electric control board 13 and a component 14. The outer box body 11 may be a metal part, such that the outer box body 11 has a relatively high structural strength. The inner box body 12 is provided in the outer box body 11. The outer box body 11 may protect the inner box body 12. The inner box body 12 includes an insulating member, for example, a plastic member. The electric control board 13 is provided in the inner box body 12. The inner box body 12 may protect the electric control board 13. Since the inner box body 12 is an insulating member, the electric control board 13 may be prevented from being short-circuited due to direct contact with the outer box body 11.

The component 14 may include a transformer. The component 14 is provided in the outer box body 11 and located outside the inner box body 12, such that the outer box body 11 may protect the component 14 and the component 14 does not interfere with the electric control board 13. The component 14 is connected with the inner box body 12, for example, connected with one side of the inner box body 12.

Since the component 14 is connected with the inner box body 12, the component 14 and the inner box body 12 are integrated to constitute a module of the electric control box assembly 1, realizing integration of the inner box body 12, the electric control board 13 and the component 14.

When the electric control box assembly 1 is assembled, the electric control board 13 may be provided in the inner box body 12 first, and then the component 14 is connected with the inner box body 12, such that the component 14 and the inner box body 12 are integrated; finally, the integrated component 14 and the inner box body 12 are mounted in the outer box body 11. Compared with the scenario where the component 14 and the inner box body 12 are separately mounted in the outer box body 11, in the electric control box assembly 1 according to the present application, by integrating the component 14 and the inner box body 12 and mounting the integrated component 14 and the inner box body 12 in the outer box body 11, the modular assembly of the electric control box assembly 1 is facilitated and the assembly efficiency of the electric control box assembly 1 is improved.

In the electric control box assembly 1 according to the present application, by providing the component 14 in the outer box body 11 and outside the inner box body 12, connecting the component 14 with the inner box body 12, and integrating the component 14 and the inner box body 12, the modular assembly of the electric control box assembly 1 is facilitated and the assembly efficiency of the electric control box assembly 1 is improved.

Referring to FIGS. 5 to 7, according to some embodiments of the present application, a mounting bracket 121 is provided at an outer side wall of the inner box body 12, and the component 14 is connected to the mounting bracket 121. Such a design facilitates connection of the component 14 to the inner box body 12 and may guarantee the connection reliability, while improving a structural strength of the inner box body 12, for example, the component 14 may be connected to the mounting bracket 121 by screws.

Referring to FIGS. 5 to 7, optionally, the mounting bracket 121 is connected with the outer box body 11. For example, the mounting bracket 121 may be connected with the outer box body 11 by screws. Such a design facilitates fixation of the inner box body 12 and the outer box body 11, thereby fixing the integrated inner box body 12 and the component 14 to the outer box body 11, and facilitating improvement of the structural strength and stability of the electric control box assembly 1.

Referring to FIGS. 6 and 7, further, the mounting bracket 121 may be connected to a lower side of the inner box body 12, and the mounting bracket 121 is connected with the outer box body 11 by a first fastener 12111, for example, a screw. A first positioning lug 1211 is formed at the inner box body 12 and may be formed at the top of the inner case body 12. A first pre-positioning hole 111 engaged with the first positioning lug 1211 is formed at the outer box body 11 and may be formed at the top of the outer box body 11. When the inner box body 12 connected with the component 14 is mounted into the outer box body 11, the inner box body 12 and the component 14 to be mounted may be pre-positioned by inserting the first positioning lug 1211 of the inner box body 12 into the first pre-positioning hole 111 of the outer box body 11 firstly, and then the mounting bracket 121 is connected with the outer box body 11 by the first fastener 12111, thereby mounting the inner box body 12 and the component 14 into the inner box body 11 conveniently and quickly.

Referring to FIGS. 5 to 7, according to some optional embodiments of the present application, the inner box body 12 and the mounting bracket 121 are integrally formed. For example, the inner box body 12 and the mounting bracket 121 may be integrally injection molded. Thus, the inner box body 12 and the mounting bracket 121 have a relatively high connection strength, such that the structure of the integrated inner box body 12 and the component 14 is more stable, and the assembly process of the electric control box assembly 1 may be simplified.

Referring to FIGS. 5 to 7, according to some optional embodiments of the present application, the mounting bracket 121 includes two mounting sub-brackets 121*a* disposed opposite to each other at intervals, the component 14 is accommodated in an accommodation space formed between the two mounting sub-brackets 121*a* and the inner box body 12, a side wall of the component 14 may abut against side walls of the two mounting sub-brackets 121*a*, and a top wall of the component 14 may abut against a bottom wall of the inner box body 12, such that the component 14 is fixed at the mounting bracket 121 more reliably and stably, and the component 14 is accommodated in the accommodation space, which may prevent the component 14 from shaking and colliding with the outer box body 11.

Referring to FIGS. 5 to 7, further, the mounting sub-bracket 121*a* has a mounting plate 1212 and a mounting column 12121 provided at the mounting plate 1212, wherein the mounting column 12121 may be formed at a side of the mounting plate 1212 apart from the component 14, such that the component 14 may be accommodated in the accommodation space formed by the mounting plates 1212 of the two mounting sub-brackets 121*a*, and the side wall of the component 14 may be substantially fitted with the mounting plate 1212, such that the component 14 is mounted stably. A connection lug 141 is provided at the component 14, and a second fastener 121211 is configured to pass through the connection lug 141 and the mounting column 12121 to connect the component 14 to the mounting bracket 121. For example, a screw hole is formed at the connection lug 141, and the second fastener 121211 includes a screw. The component 14 is fixed at the mounting bracket 121 by passing the second fastener 121211 through the connection lug 141 and the mounting column 12121, such that the component 14 and the mounting bracket 121 have a relatively high connection strength, the integral structure of the connected inner box body 12 and the component 14 is more stable, which facilitates improvements of the structural strength and stability of the electric control box assembly 1.

Referring to FIGS. 5 to 7, further, a fixation hole 131 is formed at the electric control board 13, a fixation column 1213 is formed at the inner box body 12, and a third fastener 12131 is configured to pass through the fixation hole 131 and the fixation column 1213 to fix the electric control board 13 in the inner box body 12, such that the electric control board 13 and the inner box body 12 have a relatively high connection strength, for example, the third fastener 12131 includes a screw. A central axis of the third fastener 12131 is perpendicular to a central axis of the second fastener 121211. For example, the central axis of the third fastener 12131 is parallel to a front and rear direction, and the central axis of the second fastener 121211 is parallel to a vertical direction. Such a design facilitates the penetration of the third fastener 12131 and the second fastener 121211, and guarantees stable and reliable connection.

Referring to FIGS. 5 to 7, according to some embodiments of the present application, a fixation hole 131 and a plurality of positioning holes 132 are formed at the electric control board 13, a fixation column 1213 and a plurality of positioning columns 1214 are formed at the inner box body 12, and the third fastener 12131 is configured to pass through the fixation hole 131 and the fixation column 1213 to fix the electric control board 13 in the inner box body 12. For example, the third fastener 12131 includes a screw. The number of positioning columns 1214 is the same as the number of positioning holes 132, and the positioning columns are in one-to-one-correspondence with the positioning holes. By engaging the plurality of positioning columns 1214 with the plurality of positioning holes 132, the number of positioning columns 1214 being the same as the number of positioning holes 132, and the positioning columns being in one-to-one-correspondence with the positioning holes, the electric control board 13 and the inner box body 12 may be initially positioned, such that the electric control board 13 is mounted in the inner box body 12 accurately, and then is further fixed in the inner box body 12 by passing the third fastener 12131 through the fixation hole 131 and the fixation column 1213, improving the connection strength of the electric control board 13 and the inner box body 12.

In the description of the present application, "plural" or "a plurality of" means two or more.

Referring to FIGS. 5 to 7, optionally, three positioning columns 1214 are provided and arranged in a triangle, and three positioning holes 132 are provided and arranged in a triangle. For example, when the electric control board 13 is approximately rectangular, one positioning hole 132 is formed in the middle of a left end of the electric control board 13, and the other two positioning holes 132 are formed at upper and lower portions of a right end of the electric control board 13 respectively, such that the three positioning holes 132 are arranged in a triangle. By engaging the three positioning columns 1214 with the three positioning holes 132, and arranging the three positioning columns 1214 and the three positioning holes 132 in a triangle respectively, the electric control board 13 is connected with the inner box body 12 accurately, and the electric control board 13 is prevented from shaking in the inner box body 12.

Referring to FIGS. 5 to 7, according to some embodiments of the present application, a portion of the outer box body 11 accommodating the inner box body 12 includes a first accommodation cavity 112, and a portion of the outer box body 11 accommodating the component 14 includes a second accommodation cavity 113. A cross sectional area of the second accommodation cavity 113 is greater than a cross sectional area of the first accommodation cavity 112, and the cross sections are perpendicular to a direction along which the inner box body 12 and the component 14 are arranged. For example, the inner box body 12 and the component 14 are arranged in the vertical direction, and the cross section is parallel to a horizontal plane. Due to its plate-like structure, the electric control board 13 has a relatively small size in a thickness direction (the thickness direction of the electric control board 13 is the front and rear direction). The inner box body 12 configured to accommodate the electric control board 13 may also have a relatively small size in the front and rear direction, such that the cross sectional area of the first accommodation cavity 112 may be designed to be smaller. The component 14 may have a relatively large size in the front and rear direction. For example, when the component 14 is a transformer, the component 14 has a relatively large size in the front and rear direction, such that the cross sectional area of the second accommodation cavity 113 accommodating the component 14 needs to be relatively large to ensure that the component 14 is accommodated in the outer box body 11 as a whole. By designing the cross sectional area of the second accommodation cavity 113 to be greater than the cross sectional area of the first accommodation cavity 112, the space requirement of the component 14 is satisfied, and the first accommodation cavity 112 is designed to be relatively small to reduce an overall volume of the electric control box assembly 1 while meeting the space requirement of the inner box body 12. When the electric control box assembly 1 is applied to an air conditioner, other parts of the air conditioner are provided conveniently and the overall volume is reduced.

Referring to FIGS. 5 to 7, optionally, the outer box body 11 has an open end 114, which facilitates the maintenance and replacement of the inner box body 12, the component 14 and the electric control board 13. A portion of the outer box body 11 opposite to the open end 114 includes a back plate 115, and the back plate 115 has a stepped shape. A raised portion of the stepped back plate 115 corresponds to the second accommodation cavity 113, and a recessed portion of the back plate 115 corresponds to the first accommodation cavity 112, thereby making the cross sectional area of the second accommodation cavity 113 greater than that of the first accommodation cavity 112, and realizing the simple and beautiful structure.

Referring to FIGS. 5 to 7, further, the mounting bracket 121 is provided at the outer side wall of the inner box body 12, and the component 14 is connected to the mounting bracket 121. Such a design facilitates the connection of the component 14 to the inner box body 12. For example, the component 14 may be connected with the mounting bracket 121 by screws. The inner box body 12 and the mounting bracket 121 form a stepped structure. For example, the mounting bracket 121 protrudes backwards in the front and rear direction, such that the inner box body 12 and the mounting bracket 121 form a stepped structure as a whole. Due to its plate-like structure, the electric control board 13 has a relatively small size in the front and rear direction. The inner box body 12 configured to accommodate the electric control board 13 may also have a relatively small size in the front and rear direction. The component 14 may have a relatively large size in the front and rear direction. The mounting bracket 121 may protrude backwards to increase a contact area between the mounting bracket 121 and the component 14, so as to improve the connection strength between the component 14 and the mounting bracket 121. At the same time, the mounting bracket 121 protrudes backwards, such that the overall structure of the inner box body 12 and the mounting bracket 121 matches the structure of the outer box body 11, wherein the mounting bracket 121 protruding backwards is accommodated in the second accommodation cavity 113, corresponding to the raised portion of the plate 115; the inner box body 12 is accommodated in the first accommodation cavity 112, corresponding to the recessed portion of the back plate 115, which improves the space utilization rate in the outer box body 11 and facilitates the reduction of the volume of the electric control box assembly 1.

Referring to FIGS. 5 to 7, according to some embodiments of the present application, a mounting lug 116 configured to mount the outer box body 11 to the complete appliance is formed at the outer box body 11. For example, when the electric control box assembly 1 is applied to the air conditioner, the mounting lug 116 may be fixed to the front enclosure plate 32 of the air conditioner by spot welding to fix the electric control box assembly 1 in the whole appliance.

Referring to FIGS. 5 to 7, according to some embodiments of the present application, two spaced wiring holes 117 are formed at the outer box body 11, one of the two wiring holes 117 is suitable for a high-voltage wire harness, and the other of the two wiring holes 117 is suitable for a low-voltage wire harness. Such a design separates the heavy current from the weak current, avoiding chaos of the wiring, and reducing the interference between the high-voltage wire harness and the low-voltage wire harness. When the electric control box assembly 1 has an electric control box cover, the electric control box cover is suitable for closing the open end 114 of the outer box body 11, and the design of the wiring hole 117 may prevent the wires from being squeezed when the outer box body 11 and the electric control box cover are closed to prevent damages to the wires.

Figure 2:
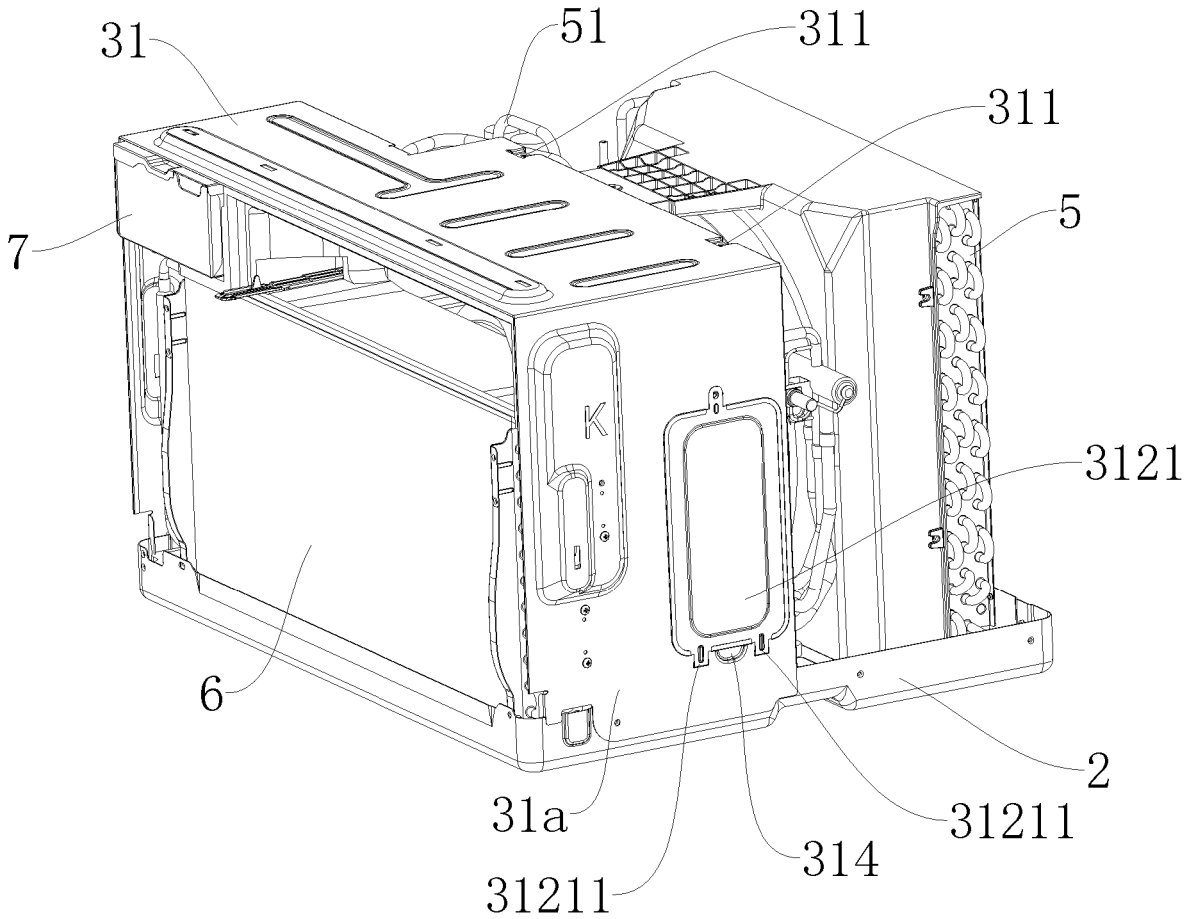
FIG. 2 is a schematic diagram of a partial structure of an air conditioner according to some embodiments of the present application.
Figure 3:
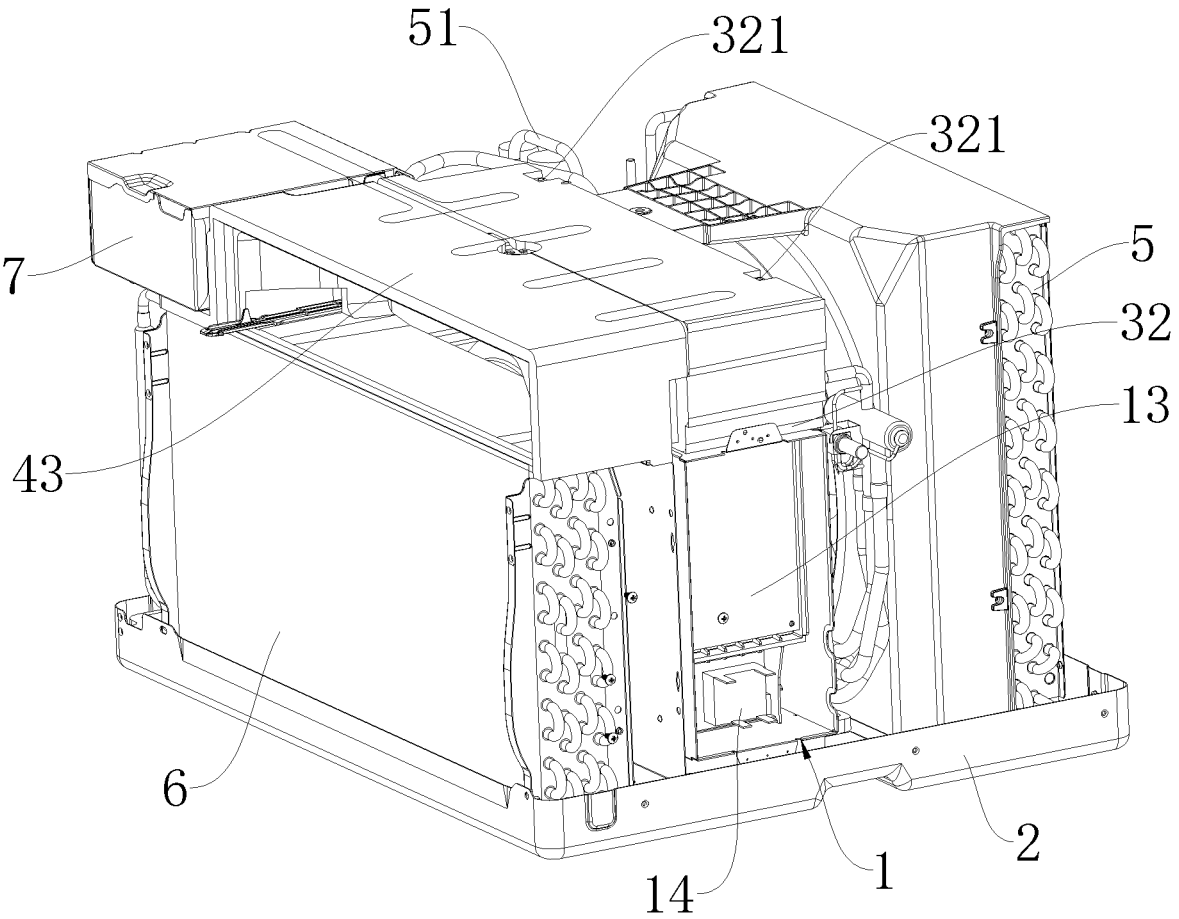
FIG. 3 is a schematic diagram of a partial structure of an air conditioner according to some embodiments of the present application.

Referring to FIGS. 1 to 3, in an air conditioner consistent with embodiments of the present application, an electric control system of the air conditioner includes the electric control box assembly 1 consistent with embodiments of the present application. For example, the air conditioner is a window air conditioner, or a split hanging air conditioner, or a split floor type air conditioner.

In the air conditioner according to the present application, by providing the above-mentioned electric control box assembly 1, the modularity of the electric control box assembly 1 is relatively high, such that the assembly efficiency of the electric control box assembly 1 is relatively high, and the assembly efficiency of the air conditioner is improved.

Referring to FIG. 1, according to some embodiments of the present application, the air conditioner is a window air conditioner. The electric control box assembly 1 is provided in the air conditioner, and may control the air conditioner.

Referring to FIGS. 1 to 4, according to some embodiments of the present application, the air conditioner includes a chassis 2 and a fixation bracket 3, wherein the chassis 2 is provided at the bottom of the air conditioner, and may carry other parts of the air conditioner. The fixation bracket 3 is provided at the chassis 2 to support and improve the structural strength. The fixation bracket 3 includes a front enclosure plate 32 and a front cover plate 31. The front cover plate 31 may be covered at the front enclosure plate 32. An enclosure plate flange may be formed at an upper edge of the front enclosure plate 32, an enclosure plate screw hole 321 may be formed at the enclosure plate flange, a cover plate screw hole 311 corresponding to the enclosure plate screw hole 321 may be formed at a top wall of the front cover plate 31, and the front enclosure plate 32 may be fixedly connected with the front cover plate 31 by passing screws through the enclosure plate screw hole 321 and the cover plate screw hole 311. The electric control box assembly 1 is provided in the fixation bracket 3. For example, the mounting lug 116 is formed at the outer box body 11 and may be connected to the front enclosure plate 32 by spot welding.

The fixation bracket 3 has a baffle 31*a* extending in the vertical direction. The open end 114 of the outer box body 11 is opposite to and in contact with the baffle 31*a*. A service opening 312 is formed at a portion of the baffle 31*a* opposite to the open end 114 of the outer box body 11, a cover 3121 configured to open and close the service opening 312 is provided at the service opening 312. When the cover 3121 closes the service opening 312, the electric control box assembly 1 is substantially closed. When the cover 3121 opens the service opening 312, the open end 114 of the outer box body 11 is exposed, and the electric control board 13 and the component 14 are exposed, which is convenient for an operator to directly repair or replace the electric control board 13 and the component 14, with no need to take out the entire electric control box assembly 1, thereby improving the maintenance efficiency and reducing the difficulty of maintenance operations.

Referring to FIGS. 1 to 4, in some embodiments of the present disclosure, the air conditioner includes a chassis 2, an indoor unit 100 and an outdoor unit 200. The indoor unit 100 and the outdoor unit 200 are both provided at the chassis 2. The indoor unit 100 includes the fixation bracket 3, a face frame assembly 4, an indoor heat exchanger assembly 6, and an indoor fan. The outdoor unit 200 includes an outdoor heat exchanger assembly 5, an outdoor fan, and a compressor assembly 51. The face frame assembly 4 is provided at a front side of the fixation bracket 3. The face frame assembly 4, the fixation bracket 3, and the chassis 2 form a mounting cavity. The indoor heat exchanger assembly 6, the indoor fan, and the electric control box assembly 1 are all provided in the mounting cavity. An air inlet 42 and an air outlet 41 are formed at the face frame assembly 4. The indoor fan may drive indoor air to enter the air conditioner from the air inlet 42 and to exchange heat with the indoor heat exchanger assembly 6. The outgoing air from the air conditioner may be discharged from the air outlet 41.

The fixation bracket 3 includes the front enclosure plate 32 and the front cover plate 31. The mounting hole configured to position the electric control box assembly 1 is formed at the front enclosure plate 32, and the electric control box assembly 1 is configured to pass through the mounting hole. The mounting lug 116 is formed at the outer box body 11 and is connected with the front enclosure plate 32 by spot welding to fix the electric control box assembly 1 and the fixation bracket 3. The front cover plate 31 is covered on the front enclosure plate 32. The baffle 31*a* constitutes a part of the front cover plate 31. The service opening 312 on the baffle 31*a* is provided opposite to the open end 114 of the outer box body 11, and to the mounting hole of the front enclosure plate 32.

Figure 4:
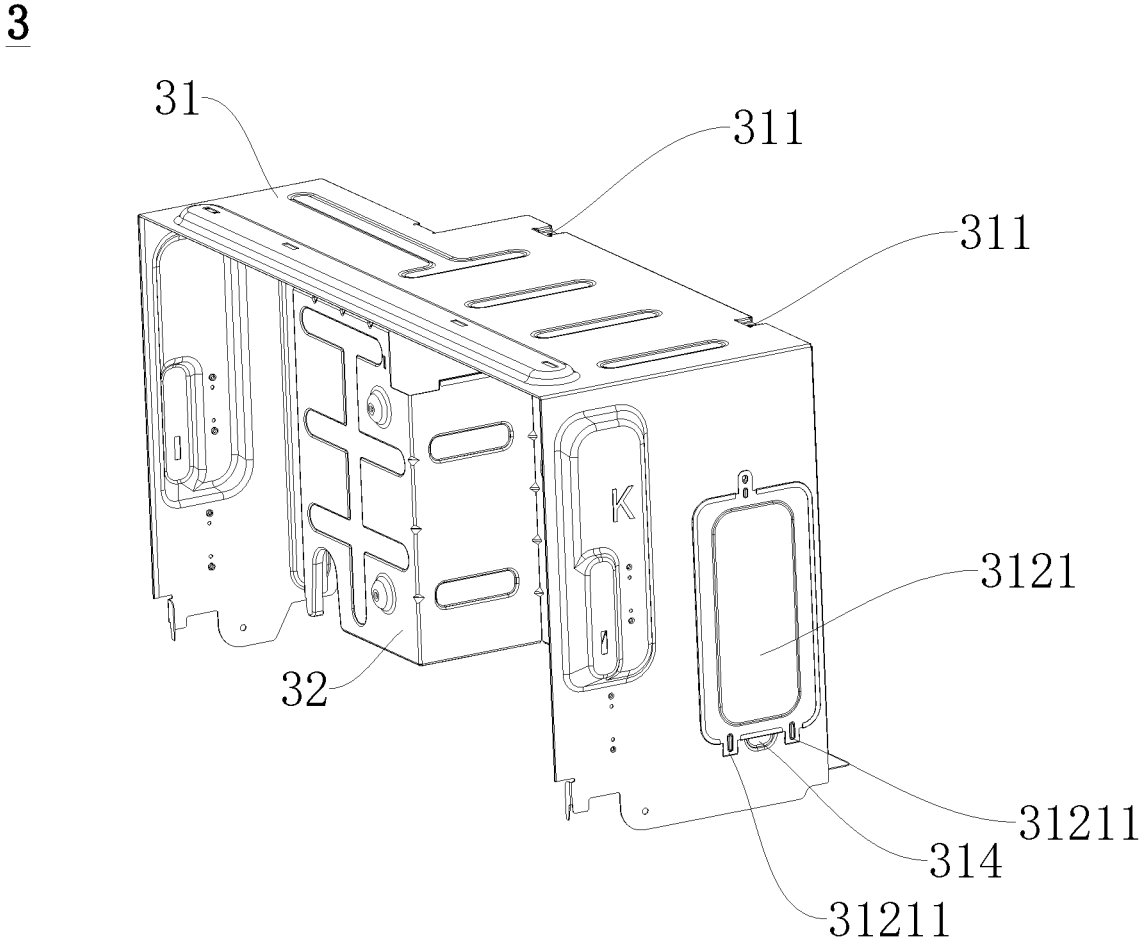
FIG. 4 is a structural diagram of a fixation bracket according to some embodiments of the present application.

Referring to FIGS. 1 and 4, according to some optional embodiments of the present application, the second positioning lug 31211 is formed at a lower end of the cover 3121, and the second pre-positioning hole 313 engaged with the second positioning lug 31211 is formed at the baffle 31*a*. By the engagement of the second positioning lug 31211 with the second pre-positioning hole 313, the cover 3121 and the baffle 31*a* may be positioned initially, such that the cover 3121 is mounted to the baffle 31*a* accurately. The upper end of the cover 3121 is connected with the baffle 31*a* by a fourth fastener 3131, so as to further fix the cover plate to the baffle 31*a*, and improve the connection strength between the cover plate and the baffle 31*a*. For example, the fourth fastener 3131 includes a screw.

Referring to FIGS. 1 and 4, according to some optional embodiments of the present application, the wiring groove 314 is formed at the baffle 31*a*, and runs through the inner side wall of the service opening 312. The wiring groove 314 may be configured for wiring, for example, configured to allow the wires of the electric control box assembly 1 to pass through. When the cover 3121 closes the service opening 312, the wires pass through the wiring groove 314 to prevent the cover 3121 from squeezing the wires and avoid damages to the wires. When the control panel is formed at the face frame assembly 4, the baffle 31*a* is closer to a control panel. By forming the wiring groove 314 at the baffle 31*a*, since the wiring groove 314 is close to the control panel, the wires connected to the control panel may pass through the wiring groove 314 directly and enter the electric control box assembly 1 to avoid the wires connected to the control panel getting tangled, which makes the wiring of the air conditioner more reasonable.

Referring to FIGS. 2 and 3, according to some optional embodiments of the present application, the fixation bracket includes the front enclosure plate 32 and the front cover plate 31. The front cover plate 31 is covered at the top of the front enclosure plate 32, and the accommodation space suitable for an air duct member 43 is formed between the front cover plate 31 and the front enclosure plate 32. For example, the air duct member 43 is a foam member, and has a function of heat insulation and sealing. The front cover plate 31 plays a role of supporting and strengthening the air duct member 43. An air duct communicating the air inlet 42 and the air outlet 41 of the air conditioner is formed in the air duct member 43. The indoor fan may drive the indoor air to enter the air duct from the air inlet 42 and to exchange heat with the indoor heat exchanger assembly 6. The outgoing air of the air conditioner may be discharged from the air outlet 41, and a part of the side wall of the front cover plate 31 constitutes the baffle 31*a*.

Referring to FIGS. 2 and 3, according to some embodiments of the present application, the electric control system includes a first electric control device 7 and a second electric control device. The first electric control device 7 is provided at a side of the air duct member 43 of the air conditioner in a horizontal direction, and the air duct communicating with the air inlet 42 and the air outlet 41 of the air conditioner is formed in the air duct member 43. The first electric control device may be wiredly connected with parts of the air conditioner, such as the fan, the compressor assembly 51, or the like, so as to supply power to the parts. The second electric control device is the above-mentioned electric control box assembly 1, and may be wiredly connected with parts of the air conditioner, such as the fan, the compressor assembly 51, or the like, so as to control the parts with an electric signal. The second electric control device may further be wiredly connected with a weak-current module, such as a WIFI module, an anion generation module, or the like, so as to control the parts. By providing the first electric control device 7 and the second electric control device, all the wires in the air conditioner are prevented from being connected to one electric control device, such that the wiring in the air conditioner is more reasonable and convenient maintenance is realized.

In some embodiments of the present application, the electric control system includes the first electric control device 7 and the second electric control device. The second electric control device is the above-mentioned electric control box assembly 1, and the electric control box assembly 1 includes the outer box body 11, the inner box body 12, the electric control board 13 and the component 14, wherein the component 14 includes a transformer, and two spaced wiring holes 117 are formed at the side wall of the outer box body 11. The transformer of the electric control box assembly 1 is connected to a power source by a high-voltage wire harness and to the electric control board 13. The transformer may adjust the current and voltage supplied by the power supply to suit the operation of the electric control board 13. The electric control board 13 of the electric control box assembly 1 is connected with a control module of parts of the air conditioner, such as the fan, the compressor assembly 51, or the like, by low-voltage wire harness, so as to control the parts with an electric signal. The electric control box assembly 1 may further be wiredly connected with a weak-current module of the air conditioner, such as a WIFI module, an anion generation module, a control panel, or the like, by low-voltage wire harness, so as to control the parts. The electric control board 13 of the electric control box assembly 1 may control the weak-current modules through the low-voltage wire harness. The high-voltage wire harness connecting the transformer of the electric control box assembly 1 and the power supply and the low-voltage wire harness connecting the electric control board 13 and the WIFI module, the anion generation module, the control panel module, the control module, or the like may pass through the two wiring holes 117 of the outer box body 11 respectively, such that the heavy current is separated from the weak current, the chaos of the wiring is avoided, and the impact between the high-voltage wire harness and the low-voltage wire harness may be reduced. The first electric control device 7 is connected to the power source through the high-voltage wire harness, and supplies power to the heavy-current part, such as the fan, the compressor assembly 51 of the air conditioner, or the like, through the high-voltage wire harness.

In the description of the present specification, reference throughout this specification to "an embodiment," "some embodiments," "exemplary embodiment," "example," "specific example" or "some examples" means that a particular feature, structure, material, or characteristic described in connection with the embodiment or example is included in at least one embodiment or example of the present disclosure. In the specification, the schematic expressions to the above-mentioned terms are not necessarily referring to the same embodiment or example. Furthermore, the described particular features, structures, materials, or characteristics may be combined in any suitable manner in one or more embodiments or examples.

Although embodiments of the present disclosure have been shown and illustrated, it shall be understood by those skilled in the art that various changes, modifications, alternatives and variants without departing from the principle and idea of the present disclosure are acceptable. The scope of the invention is defined by the claims and its equivalents.

What is claimed is:

1. An electric control box assembly comprising:

an outer box body;

an inner box body accommodated in the outer box body and connected to the outer box body, the inner box body including an insulating member;

an electric control board provided in the inner box body, the insulating member being between the electric control board and the outer box and configured to prevent the electric control board from contacting the outer box body; and a component provided in the outer box body and located outside the inner box body, the component being connected with the inner box body.

2. The electric control box assembly according to claim 1, further comprising:

a mounting bracket provided at an outer side wall of the inner box body;

wherein the component is connected to the mounting bracket.

3. The electric control box assembly according to claim 2, wherein the mounting bracket is connected with the outer box body.

4. The electric control box assembly according to claim 3, further comprising:

a fastener connecting the mounting bracket with the outer box body;

wherein:

the inner box body includes a positioning lug; and the outer box body includes a pre-positioning hole fitted with the positioning lug.

5. The electric control box assembly according to claim 2, wherein the inner box body is integrally formed with the mounting bracket.

6. The electric control box assembly according to claim 2, wherein the mounting bracket includes two mounting sub-brackets disposed opposite to and spaced apart from each other, the component being accommodated in an accommodation space formed by the two mounting sub-brackets and the inner box body.

7. The electric control box assembly according to claim 6, further comprising:

a fastener;

wherein:

one of the mounting sub-brackets includes a mounting plate and a mounting column provided on the mounting plate;

the component includes a connection lug; and the fastener is configured to pass through the connection lug and the mounting column to connect the component to the mounting bracket.

8. The electric control box assembly according to claim 7, wherein:

the electric control board includes a fixation hole;

the inner box body includes a fixation column; and the fastener is a first fastener;

the electric control box assembly further comprising:

a second fastener configured to pass through the fixation hole and the fixation column to fix the electric control board in the inner box body, a central axis of the second fastener being perpendicular to a central axis of the first fastener.

9. The electric control box assembly according to claim 1, further comprising:

a fastener;

wherein:

the electric control board includes a fixation hole and a plurality of positioning holes;

the inner box body includes a fixation column and a plurality of positioning columns;

the third fastener is configured to pass through the fixation hole and the fixation column to fix the electric control board in the inner box body; and a number of the positioning columns is same as a number of the positioning holes, the positioning columns being in one-to-one-correspondence with the positioning holes.

10. The electric control box assembly according to claim 9, wherein the plurality of positioning columns include three positioning columns arranged in a triangle, and the plurality of positioning holes include three positioning holes arranged in a triangle.

11. The electric control box assembly according to claim 1, wherein the outer box body includes a first accommodation cavity accommodating the inner box body and a second accommodation cavity accommodating the component, an area of a first cross section of the first accommodation cavity being smaller than an area of a second cross section of the second accommodation cavity, and the first cross section and the second cross section being perpendicular to a direction along which the inner box body and the component are arranged.

12. The electric control box assembly according to claim 11, wherein the outer box body includes an open end and a back plate opposite to the open end, the back plate being step shaped.

13. The electric control box assembly according to claim 1, wherein the outer box body includes a mounting lug configured to mount the outer box body to an appliance.

14. The electric control box assembly according to claim 1, wherein the outer box body includes two wiring holes spaced apart from each other, one of the two wiring holes being configured to allow a high-voltage wire harness to pass through, and another one of the two wiring holes being configured to allow a low-voltage wire harness to pass through.

15. The electric control box assembly according to claim 1, wherein the component includes a transformer.

16. An air conditioner comprising a chassis;

a fixation bracket provided on the chassis and including a baffle; and an electric control box assembly provided in the fixation bracket and including:

an outer box body, an open end of the outer box body being opposite to and in contact with the baffle;

an inner box body accommodated in the outer box body and connected to the outer box body, the inner box body including an insulating member;

an electric control board provided in the inner box body, the insulating member being between the electric control board and the outer box and configured to prevent the electric control board from contacting the outer box body; and a component provided in the outer box body and located outside the inner box body, the component being connected with the inner box body;

wherein:

an open end of the outer box body is opposite to and in contact with the baffle;

the baffle includes a service opening formed in a portion of the baffle that is opposite to the open end of the outer box body; and a cover configured to open and close the service opening is provided at the service opening.

17. The air conditioner according to claim 16, wherein:

the cover includes a positioning lug formed at a lower end of the cover;

the baffle includes a pre-positioning hole fitted with the positioning lug; and an upper end of the cover is connected with the baffle by a fastener.

18. The air conditioner according to claim 16, wherein:

the fixation bracket includes:

a front enclosure plate; and a front cover plate covering a top of the front enclosure plate;

an accommodation space is formed between the front cover plate and the front enclosure plate and accommodates an air duct member;

an air duct is formed in the air duct member and is in communication with an air inlet and an air outlet of the air conditioner; and the baffle includes a part of a side wall of the front cover plate.

19. The air conditioner according to claim 16, wherein an electric control system of the air conditioner includes:

a first electric control device provided at a side of an air duct member of the air conditioner in a horizontal direction, an air duct being formed in the air duct member and in communication with an air inlet and an air outlet of the air conditioner; and a second electric control device including the electric control box assembly and provided below the air duct member.

20. An electric control box assembly comprising:

an outer box body including an open end and a back plate opposite to the open end, the back plate being step shaped;

an inner box body accommodated in the outer box body and connected to the outer box body, the inner box body including an insulating member;

an electric control board provided in the inner box body, the insulating member being between the electric control board and the outer box and configured to prevent the electric control board from contacting the outer box body;

a mounting bracket provided at an outer side wall of the inner box body, the mounting bracket and the inner box body forming a stepped structure matching the step shaped back plate of the outer box body; and a component provided in the outer box body and located outside the inner box body, the component being connected with the inner box body through the mounting bracket.

* * * * *